US005482337A

United States Patent [19]

Rose

[11] Patent Number: 5,482,337

[45] Date of Patent: Jan. 9, 1996

[54] PORTABLE ANIMAL EXCREMENT SCOOP

[76] Inventor: Archie D. Rose, 1001 Strachan Dr. #8, Fort Collins, Colo. 80525

[21] Appl. No.: 451,664

[22] Filed: May 26, 1995

[51] Int. Cl.[6] ..... A01K 29/00; E01H 1/12

[52] U.S. Cl. ..... 294/1.4

[58] Field of Search ..... 294/1.3–1.5, 19.1, 294/68.22, 68.25, 55; 15/257.1, 257.3, 257.6; 119/161; 222/544

[56] References Cited

U.S. PATENT DOCUMENTS 3,804,448 4/1974 Schmieler ..... 294/1.4
3,994,522 11/1976 Hinshaw ..... 294/55 X
4,042,269 8/1977 Skermetta ..... 294/1.5
4,368,907 1/1983 Ross ..... 294/1.4
4,645,252 2/1987 Riley ..... 294/1.4

*Primary Examiner*—Johnny D. Cherry
*Attorney, Agent, or Firm*—Dean P. Edmundson

[57] ABSTRACT

An excrement scoop having an elongated handle and a cup secured to one end. A valve is associated with an aperture in the lower end of the cup. The valve permits water and air to flow out of the cup through the aperture and prevents water from entering the cup through the bottom end. The cup can be easily cleaned in a conventional toilet, for example.

8 Claims, 2 Drawing Sheets

PORTABLE ANIMAL EXCREMENT SCOOP

FIELD OF THE INVENTION

This invention relates to excrement scoops. More particularly, this invention relates to portable devices for picking up and disposing of animal feces from dogs and cats, for example.

BACKGROUND OF THE INVENTION

A variety of devices have been proposed in the past for picking up and disposing of animal waste. Some of such devices have been as simple as a small shovel or scoop, and some have been very elaborate and sophisticated devices. All of such prior devices have exhibited various disadvantages and limitations.

U.S. Pat. No. 4,0042,269 describes a portable toilet for pets and it includes a container having both a hinged top and a hinged bottom. Control buttons below the handle grip are connected with wires to enable the top or the bottom to move to an open position against the action of a spring. Inside the container is a filter or bag for catching the animal droppings. This is a relatively cumbersome device to use and would be more expensive than many people would desire.

U.S. Pat. No. 4,555,132 also describes a portable canine commode or toilet having an open top and, optionally, open bottom which are each individually closed with hinged covers. A bag can be included in the container which is open at the top end to catch dog droppings. This complicated device appears to be limited to collecting droppings directly under a dog, and it does not appear to be useful for picking up dog waste from the ground.

U.S. Pat. No. 4,368,907 describes a device for collecting animal waste which includes a compartmented container with openings on opposite ends thereof. A hinged door separates two compartments in the container. Opening of the doors to the opposite ends of the container is controlled with separate levers. A bag or disposable receptacle can be inserted into the second compartment for receiving the waste. This device is also more complicated than necessary and would be difficult to clean.

U.S. Pat. No. 4,741,566 describes a dog waste collector which includes a container with a scraper on one end which is controlled by a lever on the handle. This device appears to be difficult to clean and has several moving parts.

U.S. Pat. No. 3, 994,522 describes a bailing device which is a container having a check valve in the bottom which allows water to flow into the container when the container is moved downwardly. The valve closes when the container is raised upwardly. There is no description of the use of such device for collecting animal waste.

SUMMARY OF THE PRESENT INVENTION

In accordance with the present invention there is provided a simple, convenient and easy to use portable device for picking up animal waste, e.g., feces, from a yard, street, sidewalk, etc. and then disposing of such waste. In a preferred embodiment the device comprises:

(a) an elongated handle member having first and second ends;

(b) a cup member having an open upper end and also including a lower end secured to the first end of the handle means; wherein the lower end of the cup member includes an aperture therein; and (c) valve means at the lower end of the cup member for closing the aperture to prevent water from entering the cup member through the lower end.

The device is conveniently carried by gripping the upper end of the handle, and the device can even be used as a walking stick or cane. Animal waste is easily and simply scooped up with the cup and can be carried to any suitable refuse container or it can be emptied into a conventional toilet.

The device is easily cleaned in a toilet or other source of water. When the device containing feces is placed in a toilet bowl, water filling the cup member forces the air out through the aperture in the lower end of the cup. The valve means closes when the toilet is flushed, and strong suction action cleans the interior of the cup. The valve means allows water to flow through the lower end of the cup when the cup is in an upright position or when the flow of the water is from the upper end of the cup to the lower end, but the valve means does not allow water to flow into the container through the lower end of the cup.

Other advantages of the device of the invention will be apparent from the following detailed description and the accompanying drawings.

BRIEF DESCRIPTION OF THE DRAWINGS

The invention is described in more detail hereinafter with reference to the accompanying drawings, wherein like reference characters refer to the same parts throughout the several views and in which.

DETAILED DESCRIPTION OF THE INVENTION

Figure 1:
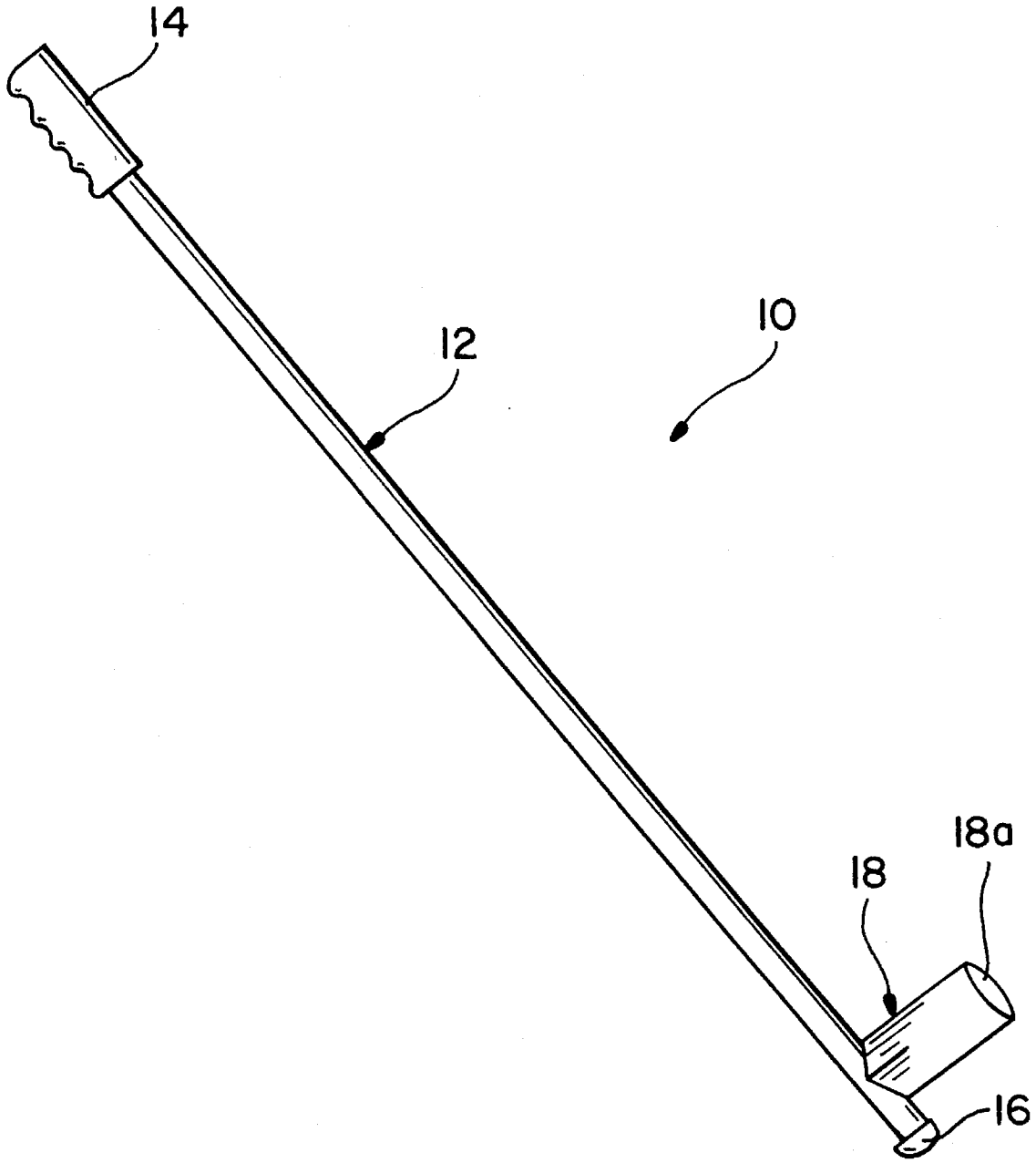
FIG. 1 is a perspective view of one embodiment of animal waste scoop of the invention.

In FIG. 1 there is shown one embodiment of portable animal waste scoop 10 of the invention comprising an elongated handle 12 having an upper end 14 (which preferably includes a rubber or plastic hand grip member) and a lower end 16 (which preferably includes a rubber tip). A cup member 18 is secured to the lower portion of the handle member. The outer or upper end 18A of the cup is open. Preferably, the cup is perpendicular to the length of the handle, as shown.

Figure 2:
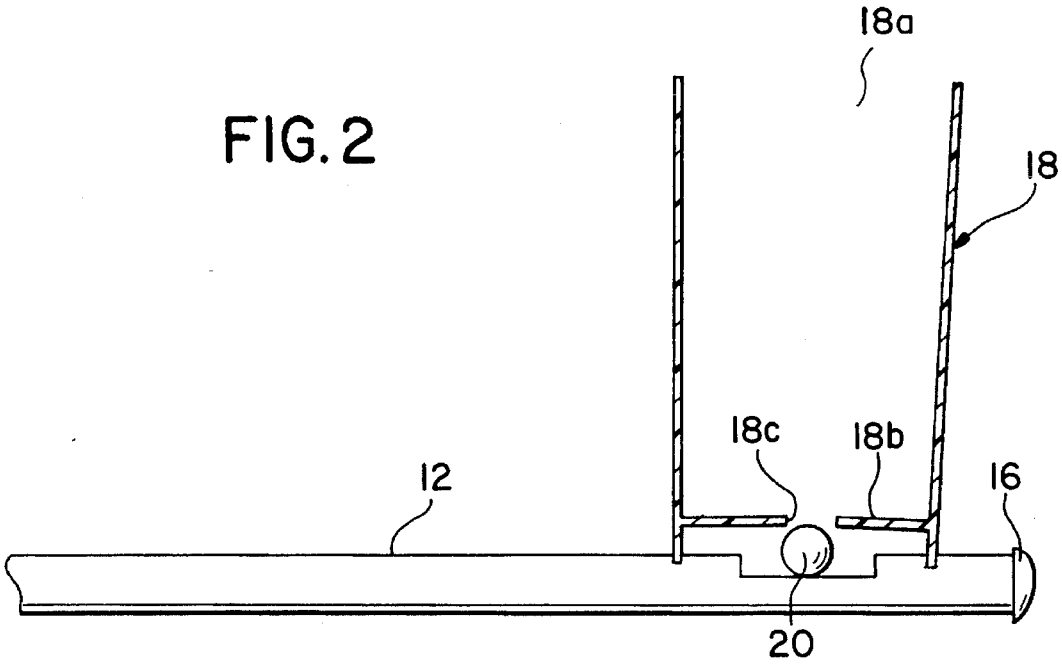
FIG. 2 is a side elevational cut-away view of a waste scoop of the invention with one embodiment of valve means.

FIG. 2 is a side elevational cut-away view of the waste scoop showing one embodiment of valve means comprising a spherical ball member 20 captured between the bottom wall 18B of the cup and the lower end of the handle 12. The bottom wall 18B includes an aperture 18C therein. The diameter of the ball 20 is greater than the diameter of the round aperture.

There is sufficient space between the bottom wall 18B and the handle to enable the ball 20 to move vertically toward or away from the aperture 18C. When the handle is rotated so that the cup is inverted, gravity will cause the ball to fall toward the aperture where it closes the aperture. The ball will also move toward the lower end of the cup and close the aperture when the cup is placed in water and moved in the direction of the ball.

This arrangement accordingly enables air and water to flow through the cup and out through the lower end, but the valve prevents water from flowing into the cup through the lower end. Most efficient cleaning and rinsing of the cup occurs when water is prevented from entering the cup through the lower end. When the cup is placed into a toilet, water can fill the cup from the top, and air can exit through the aperture in the bottom. When the toilet is flushed, the contents of the cup are sucked out the open top end of the cup.

Figure 3:
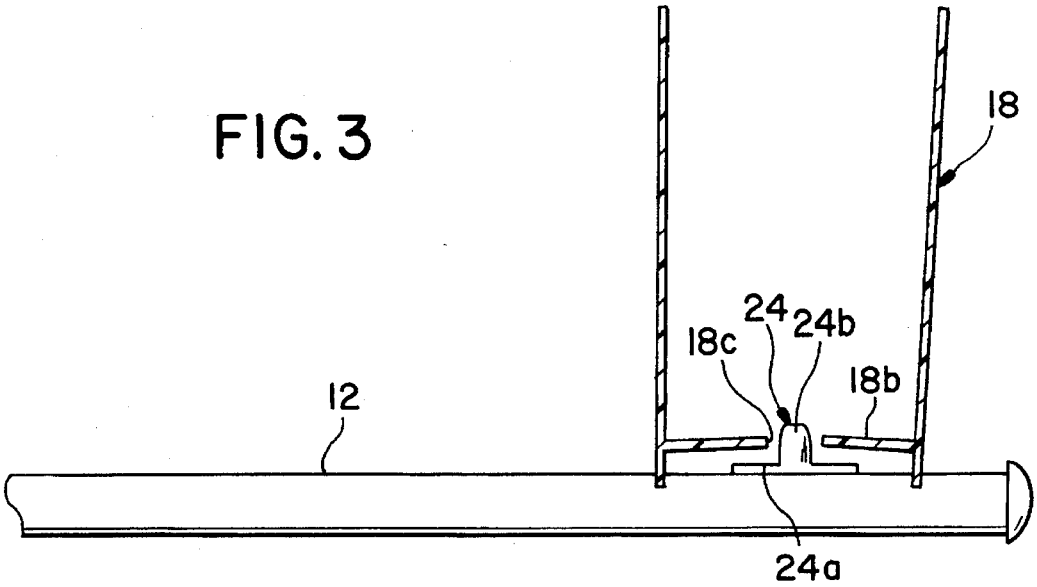
FIG. 3 is a side elevational cut-away view of a waste scoop of the invention with another embodiment of valve means.

FIG. 3 illustrates another embodiment of valve means which is useful in this invention. The valve comprises a vertically movable stopper member 24 which includes a round flange 24A and an upwardly projecting finger 24B. The finger projects upwardly through the aperture 18*c*. The finger has a diameter which is smaller than the diameter of the aperture and serves as a guide for vertical movement of the flange 24A. The diameter of the flange member is greater than the diameter of the aperture.

When the cup is inverted or moved in water in the direction of the flange, the flange moves against the bottom wall of the cup and seals or blocks the aperture to prevent water from entering the cup through the lower end. Yet the stopper moves downwardly away from the aperture and toward the handle 12 to enable air and water to flow out of the cup through the aperture.

Figure 4:
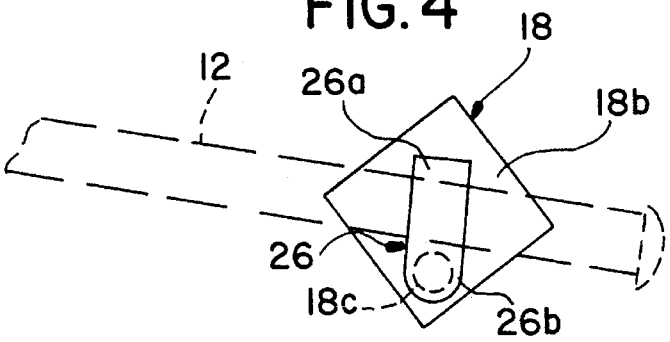
FIG. 4 is a bottom view of a waste scoop of the invention with another embodiment of valve means useful herein.

FIG. 4 illustrates another embodiment of valve means useful in this invention comprising a flexible and resilient flapper 26 which is secured at one end 26A to the underside of the lower end 18B of the cup. The flapper extends over the aperture 18C in the lower end of the cup. The flapper enables air and water to flow out of the cup through the aperture but it prevents water from entering the cup through the aperture.

Other variants are possible without departing from the scope of the invention. The size of the cup may vary. The shape may also vary, as desired. A particularly useful shape is shown in the drawings where the cup has a square lower end and a round upper end. The size of the aperture in the lower end of the cup may also vary, although a diameter in the range of about 0.5 to 0.75 inch is quite suitable.

What is claimed is:

1. Portable animal excrement scoop comprising:

(a) elongated handle means having first and second ends;

(b) a cup member having an open upper end and also including a lower end secured to said first end of said handle means; wherein said lower end of said cup member includes an aperture therein; and valve means at said lower end of said cup member which permits water flow out of said cup member and which prevents water flow into said cup member through said aperture.

2. A scoop in accordance with claim 1, wherein said second end of said handle means includes a grip handle.

3. A scoop in accordance with claim 1, wherein said valve means comprises a spherical ball member.

4. A scoop in,accordance with claim 3, wherein said ball member is captured between said lower end of said cup member and said handle means; wherein said ball member is movable between a first position where said ball member is out of contact with said aperture and a second position where said ball member blocks said aperture.

5. A scoop in accordance with claim 1, wherein said cup member is perpendicular to said handle means.

6. A scoop in accordance with claim 1, wherein said valve means comprises a stopper having an upwardly projecting finger secured to a flange; wherein said flange has a diameter greater than the diameter of said aperture; and wherein said finger projects through said aperture.

7. A scoop ill accordance with claim 6, wherein said stopper is movable between a first position where said flange is out of contact with said lower end of said cup member and a second position where said flange is in contact with said lower end of said cup member.

8. A scoop in accordance with claim 1, wherein said valve means comprises a flapper secured to said lower end of said cup member adjacent to said aperture; wherein said flapper is dimensionally larger than said aperture; wherein said flapper is flexible and resilient and is movable between an open position where said flapper is out of contact with said aperture and a closed position where said flapper covers said aperture.

* * * * *